US008919161B2

(12) United States Patent
Pozzi

(10) Patent No.: US 8,919,161 B2
(45) Date of Patent: Dec. 30, 2014

(54) MECHANICAL MODULE FOR A VEHICLE KEY, AND METHOD FOR MAKING SAME

(75) Inventor: Didier Pozzi, Ermont (FR)

(73) Assignee: Johnson Controls Technology Company, Holland, MI (US)

( * ) Notice: Subject to any disclaimer, the term of this patent is extended or adjusted under 35 U.S.C. 154(b) by 571 days.

(21) Appl. No.: 13/127,703

(22) PCT Filed: Nov. 5, 2009

(86) PCT No.: PCT/EP2009/007941

§ 371 (c)(1),
(2), (4) Date: Jul. 25, 2011

(87) PCT Pub. No.: WO2010/052003

PCT Pub. Date: May 14, 2010

(65) Prior Publication Data

US 2011/0277521 A1 Nov. 17, 2011

(30) Foreign Application Priority Data

Nov. 5, 2008 (DE) ..... 10 2008 055 986

(51) Int. Cl.

| | |
|---|---|
| ***A44B 15/00*** | (2006.01) |
| ***A45C 11/32*** | (2006.01) |
| ***A47G 29/10*** | (2006.01) |
| ***E05B 19/04*** | (2006.01) |
| ***G07C 9/00*** | (2006.01) |
| *E05B 15/16* | (2006.01) |
| *E05B 17/00* | (2006.01) |

(52) U.S. Cl.

CPC ..... *E05B 19/043* (2013.01); *G07C 9/00944* (2013.01); *E05B 15/1607* (2013.01); *E05B 17/0004* (2013.01)

USPC ..... 70/456 R; 70/396; 70/399; 70/459

(58) Field of Classification Search

USPC ..... 70/395–397, 399, 401, 408, 456 R, 459, 70/460; 24/3.6; 206/38.1, 37.1, 37.2, 37.3, 206/37.4, 37.5, 37.6, 37.7, 37.8

See application file for complete search history.

(56) References Cited

U.S. PATENT DOCUMENTS 6,499,326 B1 * 12/2002 Heussner ..... 70/399
7,596,977 B2 * 10/2009 Eychenne et al. ..... 70/257

(Continued)

FOREIGN PATENT DOCUMENTS

DE 39 02 537 A1 8/1990
DE 42 26 579 A1 2/1994

(Continued)

OTHER PUBLICATIONS

International Search Report for PCT/EP2009/007941, dated Mar. 4, 2010 (6 pages).

*Primary Examiner* — Lloyd Gall
*Assistant Examiner* — David E Sosnowski
(74) *Attorney, Agent, or Firm* — Foley & Lardner LLP

(57) ABSTRACT

The present invention relates to a key (1) and to a mechanical module for a key (1), comprising a body (2), the body (2) including a first body portion (21) and a second body portion (22), the first and second body portions (21, 22) being mechanically secured to each other via a shape assembly, the first body portion (21) including a base member (21') and a matching member (23), the matching member (23) achieving the shape assembly with the second portion (22), and the matching member (23) and the base member (21') being connected by an adhesive or welded connection.

8 Claims, 3 Drawing Sheets

(56) References Cited

U.S. PATENT DOCUMENTS

| | | | | |
|---|---|---|---|---|
| 8,225,633 | B2 * | 7/2012 | Luo et al. | 70/456 R |
| 8,479,547 | B2 * | 7/2013 | Kataya et al. | 70/456 R |
| 8,534,104 | B2 * | 9/2013 | Shimura et al. | 70/456 R |
| 2001/0042392 | A1 * | 11/2001 | Meynier | 70/408 |
| 2002/0100784 | A1 * | 8/2002 | Baird | 224/679 |
| 2006/0027520 | A1 * | 2/2006 | Belden | 215/302 |
| 2007/0062229 | A1 * | 3/2007 | Miyata et al. | 70/408 |
| 2007/0223152 | A1 | 9/2007 | Murakami et al. | |
| 2011/0030430 | A1 * | 2/2011 | Gueble | 70/396 |
| 2011/0259064 | A1 * | 10/2011 | David et al. | 70/397 |

FOREIGN PATENT DOCUMENTS

| | | | |
|---|---|---|---|
| FR | 2815521 | A1 | 4/2002 |
| JP | 07-238721 | A | 9/1995 |

* cited by examiner

MECHANICAL MODULE FOR A VEHICLE KEY, AND METHOD FOR MAKING SAME

CROSS REFERENCE TO RELATED APPLICATIONS

This application is a National Stage application of PCT/EP2009/007941, filed on Nov. 5, 2009, which claims priority of German Patent Application 10 2008 055 986.5, filed Nov. 5, 2008, the entire disclosures of which are hereby incorporated by reference herein.

The present invention relates to a mechanical module, notably for a vehicle key and to a method of manufacturing such a module.

Vehicle keys are generally known. They are notably intended for example for locking or unlocking the opening leaves of the vehicle, for example the doors, operating a tail gate, an antitheft lock and/or a starter of the vehicle.

Moreover, vehicle keys which comprise a key body that forms a housing for electronic means of remote control of means for locking the opening leaves of the vehicle are known, notably from French patent application FR 2 815 521 A1. The housing often comes in two parts each of which forms approximately half of the housing. The housing may be designed so that the two parts of the housing can be taken apart or so that the two parts of the housing cannot be taken apart without destroying or at the very least damaging the housing.

Moreover, known keys comprise an insert mounted on the key body such that it can pivot about an axis of rotation between, on the one hand, a position of use and, on the other hand, a storage position.

The body of the key may adopt varying shapes depending notably on the desired esthetic look.

One disadvantage of such keys according to the prior art is the need to provide relatively complicated tools for manufacturing those regions of the housing that perform the assembly function.

It is a notable object of the present invention to remedy the disadvantages of the known art, notably those mentioned hereinabove, and another object of the present invention is to provide a mechanical module, notably for a vehicle key, and a method of manufacturing such a module, which is inexpensive and produces a mechanical module which remains of very high quality despite the fact that it is used over a number of years and on a daily basis.

According to the invention, this object is achieved using a mechanical module, notably for a key, comprising a body, the body comprising a first body part and a second body part, the first and second body parts being fixed together mechanically using assembly by means of shape, the first body part comprising a base element and a complementary element, the complementary element performing the assembly by means of shape with the second part, and the complementary element and base element being joined together by an adhesive or welded bond.

Thus it is advantageously possible to produce the housing of the mechanical module, notably for the vehicle key, in a way that is very robust and such that it is practically impossible to open the housing, that is to say to take the first part and the second part apart without destroying at least one of them. Moreover, the fact that the first part of the housing comes in two different parts means that, for the first part of the housing, it becomes possible to use a molding tool which is simpler and therefore to apply a less expensive molding method. In particular, it is possible to produce the undercut function without the use of a molding tool that comprises a slide.

One preferred improvement of the invention lies in the fact that, on the one hand, the complementary element of the first part and, on the other hand, the second part butt together along a bearing surface, the bearing surface forming a right angle with respect to the direction in which the first part and the second part are assembled.

Through such an embodiment it is advantageously possible for the housing of the mechanical module to be a housing that cannot be taken apart without destroying the parts of the housing.

Another preferred improvement of the invention lies in the fact that the complementary element comes in the form of a peripheral annulus along the bearing surface.

Thus it is advantageously possible to reduce the cost price of the housing and thus of the mechanical module. In particular, it is preferable according to the present invention for the complementary element to be housed in a recess of the base element of the first part.

Another preferred improvement of the invention lies in the fact that the module is a key module comprising an insert mounted on the key body. For preference, the insert is able to pivot about an axis of rotation between a position of use and a storage position, the mechanical module preferably being of the type comprising a pivoting support bearing the insert and collaborating with a control button.

Thus it is advantageously possible to achieve simple and effective operation of the mechanical module of the key and to give the housing sufficient mechanical stability to create a key.

Moreover, the present invention also relates to a key, notably a vehicle key, the key comprising a mechanical module according to the present invention.

Moreover, the present invention also relates to a method of manufacturing a mechanical module, according to the present invention, the method of manufacture comprising the following steps:

- during a first step, the base element is formed by molding,
- during a second step, the complementary element is formed and is connected to the base element by an adhesive or welded bond,
- during a third step, the first part and the second part are joined together without the possibility of being taken apart.

Other features and advantages of the invention will become apparent from reading the description which follows of one particular nonlimiting embodiment of the present invention.

BRIEF DESCRIPTION OF THE DRAWINGS

The invention will be better understood from the following description which relates to some preferred embodiments given by way of nonlimiting examples and explained with reference to the attached schematic drawings in which.

DESCRIPTION OF THE DRAWINGS

Figure 1:
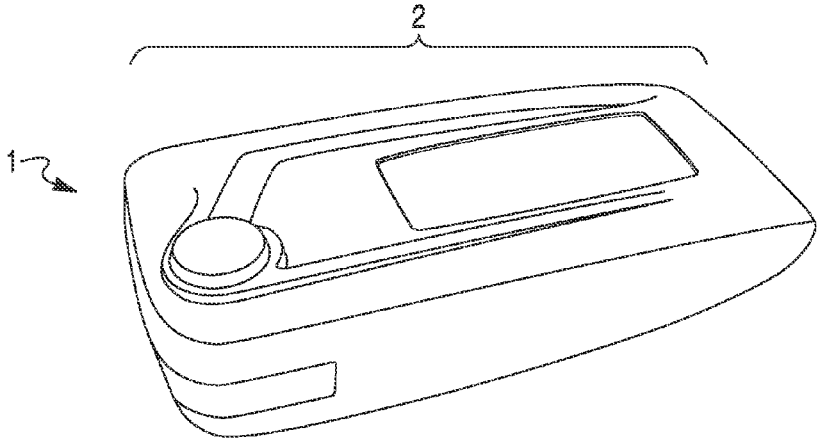
FIG. 1 is a schematic view of a vehicle key according to the present invention, the key by way of example comprising an insert and the insert being in a storage position.
Figure 2:
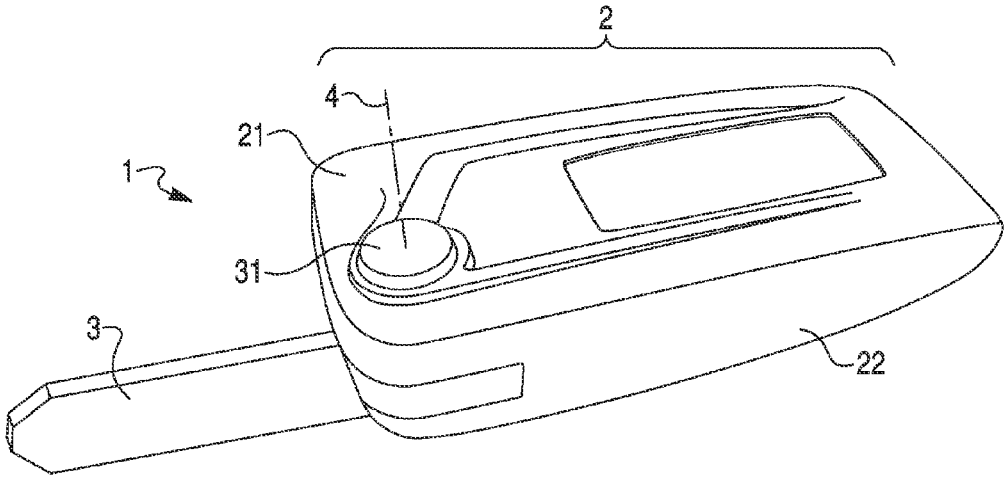
FIG. 2 is a schematic view of the vehicle key according to the present invention, the key by way of example comprising an insert and the insert being in a position of use.

FIGS. 1 and 2 of the attached drawing show, by way of example, a key 1 comprising a mechanical module according to the present invention. The key 1 is intended, for example, for locking or unlocking the opening leaves of the vehicle, for operating an antitheft lock and a starter of this vehicle, etc. In the example depicted, the key 1 comprises a key body 2, in the overall shape of a yoke, comprising at least a first part 21 of a housing of the key body 2 and a second part 22 of the housing of the key body 2. The first and second parts 21, 22 are preferably manufactured by molding. The key body 2 notably carries electronic elements.

The electronic elements comprise conventional electronic means intended, for example, for the remote control of the means of locking the opening leaves of the vehicle or the means of identifying a user who is authorized to use the vehicle.

The key may comprise an insert 3 and a control button controlling the rotary movements of the insert 3 with respect to the key body 2 about an imaginary axis of rotation (or of pivoting) 4 of the insert 3 with respect to the key body 2. The insert 3, also known as the key bit, is designed, for example, with a flat overall shape. The rotary movement about the axis of rotation allows the insert 30 to move between a storage position like the one illustrated notably in FIG. 1, and a position of use as illustrated notably in FIG. 2.

Figure 3:
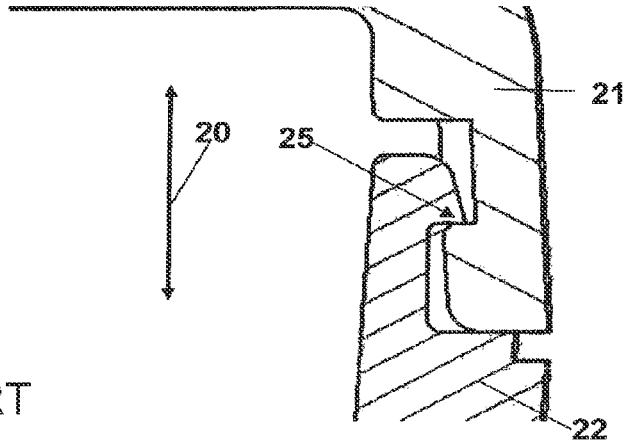
PRIOR ART Fig. 3
FIG. 3 schematically shows a view in cross section between a first part and a second part of a housing in the event that at least one of the parts has been manufactured using a molding tool that comprises a slide.
Figure 4:
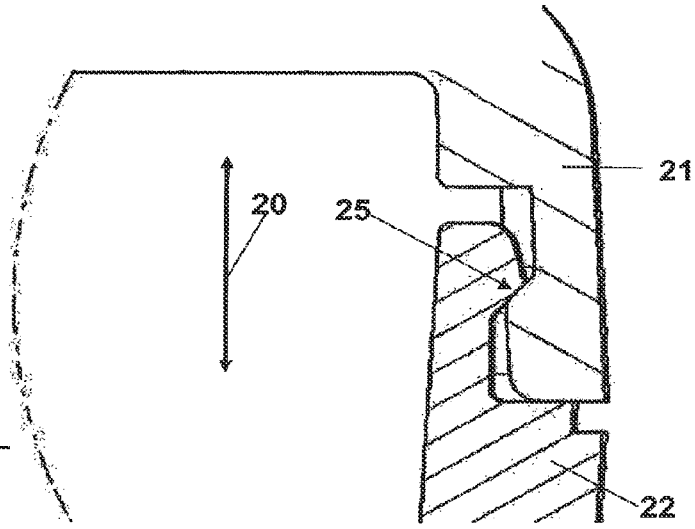
PRIOR ART Fig. 4
FIG. 4 schematically shows a view in cross section between a first part and a second part of a housing in the event that at least one of the parts has been manufactured using a stripper.

FIGS. 3 and 4 are depictions of views in cross section of a housing or of a mechanical module comprising a first part 21 and a second part 22 which are not manufactured according to the present invention. FIG. 3 illustrates a schematic view in cross section in the event that at least the first part 21 has been manufactured using a molding tool comprising a slide. At a bearing surface 25 where the first part 21 butts against the second part 22, the bearing surface 25 is directed more or less perpendicular to a direction of assembly 20. Such an embodiment of the first part 21 and/or of the second part 22 requires the use of a slide when molding the parts 21, 22. The use of a slide when molding the first part 21 has to be performed by a slide inside the first part 21, which means that a peripheral undercut (running around the entirety of the first part 21) cannot be achieved. FIG. 4 depicts a schematic view in cross section in the event that at least one of the parts has been manufactured using a stripper when molding the parts 21, 22. The use of a stripper means that the bearing surface 25 along which the first part 21 and the second part 22 bear against one another is inclined with respect to the direction 20 in which the two parts 21, 22 are assembled. The fact that the bearing surface 25 is inclined means that the two parts 21, 22 can be taken apart and therefore results in a weak mechanical bond.

Figure 5:
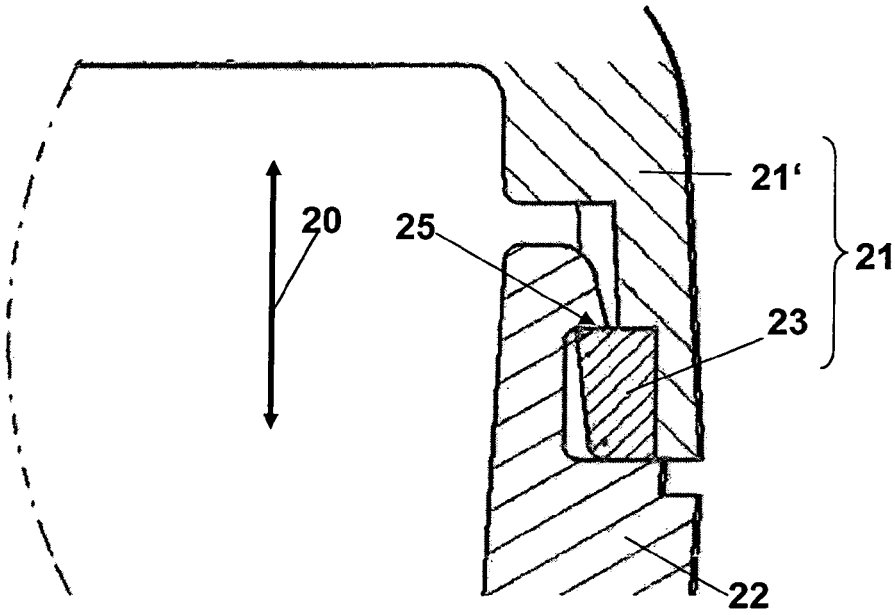
FIG. 5 schematically shows a view in cross section between a first part and a second part of a housing according to the present invention, in which the first part comprises a base element and a complementary element.

On FIGS. 3 to 5, only FIG. 5 schematically shows a view in cross section between a first part 21 and a second part 22 of a housing according to the present invention. The first part comprises a base element 21' and a complementary element 23. The complementary element 23 lies in the region of the bearing surface 25 along which the two parts 21, 22 bear against one another. With the present invention, it is possible to achieve the following two advantages simultaneously:

the manufacture of the first part 21 in such a way as to confer upon the bearing surface 25 an inclination that is such that the bearing surface 25 is directed perpendicular to the direction 20 of assembly, and the manufacture of the first part 21 without using a slide during molding.

The complementary element 23 is manufactured independently of the base element 21' of the first part 21. Before the first part 21 and the second part 22 are joined together, the base element 21' and the complementary element 23 are attached to one another, for example using an adhesive or a weld. According to the present invention, it is preferable to use ultrasonic welding to join the base element 21' to the complementary element.

The complementary element 23 is preferably an element in the overall form of a ring which is positioned with respect to the base element 21' peripherally, that is to say along the bearing surface 25 which itself runs around the first part 21 and the second part 22.

REFERENCE SYMBOLS

1 Key
2 Key body
3 Insert
4 Axis of rotation of the insert
20 Direction of assembly
21 First part of the housing
21' Base element
22 Second part of the housing
23 Complementary element
25 Bearing surface
31 Control button

The invention claimed is:

1. A mechanical module for a key, comprising:

a body, the body comprising a first body part and a second body part, the first and second body parts being fixed together mechanically upon assembly by relative movement of the first body part and the second body part toward one another in a direction of assembly, wherein the first body part comprises a base element and a complementary element, the complementary element having a first surface, and the complementary element and base element being joined together by an adhesive or welded bond, wherein the second body part has a second surface, wherein the second body part extends around the complementary element such that the first surface of the complementary element of the first body part and the second surface of the second body part butt together along a bearing plane to fix together the first and second body parts, the bearing plane forming a right angle with respect to the direction in which the first body part and the second body part are assembled, wherein the complementary element is formed as a peripheral annulus along the bearing plane, and wherein the second body part extends around the complementary element such that the second surface exerts a force against the first surface in a direction opposite to the direction of movement of the second body part toward the first body part during assembly.

2. The mechanical module as claimed in claim 1, wherein the module is a key module comprising an insert mounted on the body.

3. A vehicle key comprising a mechanical module as claimed in claim 1.

4. A method of manufacturing a mechanical module, as claimed in claim 1, the method of manufacturing comprising:

forming the base element by molding, forming the complementary element and connecting the complementary element to the base element by an adhesive or welded bond, joining the first body part and the second body part together such that the first and second body parts cannot be taken apart without destroying the first and second body parts.

5. The method of manufacturing as claimed in claim 4, wherein the complementary element is connected to the base element by ultrasonic welding.

6. The mechanical module of claim 1, wherein a cross-section of the complementary element is defined by two rectilinear opposed sides and a substantially flat top portion at the bearing plane.

7. A method of manufacturing a mechanical module for a key, comprising:

forming a base element of a first body part of a housing by molding;

forming a complementary element of the first body part and connecting the complementary element to the base element by an adhesive or welded bond, the complementary element having a first surface;

joining together the first body part and a second body part by relative movement of the first body part and the second body part toward one another in a direction of assembly such that the first and second body parts cannot be taken apart without destroying the housing, wherein the second body part has a second surface, wherein the second body part extends around the complementary element such that the first surface of the complementary element of the first body part and the second surface of the second body part butt together along a bearing plane to fix together the first and second body parts, the bearing plane forming a right angle with respect to the direction in which the first body part and the second body part are assembled, wherein the complementary element is formed as a peripheral annulus along the bearing plane, and wherein the second body part extends around the complementary element such that the second surface exerts a force against the first surface in a direction opposite to the direction of movement of the second body part toward the first body part during assembly.

8. The method of claim 7, wherein a cross-section of the complementary element is defined by two rectilinear opposed sides and a substantially flat top portion at the bearing plane.

* * * * *